United States Patent [19]

Kenyon

[11] 4,339,059

[45] Jul. 13, 1982

[54] DECORATIVE TIE BOW

[75] Inventor: Douglas A. Kenyon, Brimfield, Mass.

[73] Assignee: Wm. E. Wright Co., West Warren, Mass.

[21] Appl. No.: 204,892

[22] Filed: Nov. 7, 1980

[51] Int. Cl.[3] ..... A41H 43/00; D04D 7/06; A41D 25/02; A41D 27/08

[52] U.S. Cl. ..... 223/46; 428/5; 2/151; 2/244

[58] Field of Search ..... 2/151, 154, 144, 245, 2/244; 223/46; 428/4, 5

[56] References Cited

U.S. PATENT DOCUMENTS

| | | | |
|---|---|---|---|
| 1,692,991 | 11/1928 | Howard | 2/151 |
| 2,104,248 | 1/1938 | Stark | 223/46 X |
| 2,584,254 | 2/1952 | Brodbeck | 223/46 X |
| 2,740,126 | 4/1956 | Nichols et al. | 2/151 |
| 2,763,080 | 9/1956 | Welch | 223/46 X |
| 4,278,714 | 7/1981 | Schwartz | 428/4 |

FOREIGN PATENT DOCUMENTS

| | | | |
|---|---|---|---|
| 789997 | 1/1958 | United Kingdom | 428/4 |
| 991809 | 5/1965 | United Kingdom | 223/46 |

*Primary Examiner*—Richard J. Scanlan, Jr.
*Attorney, Agent, or Firm*—Chapin, Neal & Dempsey

[57] ABSTRACT

A tie bow of ribbon for gift packages and a process of fabricating the bow are disclosed. The bow is formed from three separate ribbon pieces and includes a looped base portion and a superposed wing portion which are united by a central tying strip. As disclosed in the bow-making process, the loop and wing are easily formed by shaping and crimping strips of single-ply ribbon and impaling them on a pair of spaced needles. The tying strip is then looped over the impaled ribbon pieces and stapled to itself to hold the strip in place and finish the bow.

2 Claims, 8 Drawing Figures

DECORATIVE TIE BOW

BACKGROUND OF THE INVENTION

This invention relates to a decorative ribbon bow for gift packages and a method of making the bow.

Briefly stated, the bow comprises three ribbon pieces: a primary piece and a second piece that are interconnected by a decorative tying strip. The primary piece is a strip of ribbon which is folded into a closed loop and crimped to form a two-ply bow having the general appearance of a bow tie; the second piece is a strip of single-ply ribbon which is twisted and crimped to form a transversely extending wing portion; and, the typing strip is another single-ply length of ribbon which is looped over the crimped central portions of the superposed loop and wing and then secured to itself to join the three pieces together in decorative tie bow form.

Due to the ease of its assembly, the tie bow can be fabricated without the need of a skilled bow maker and can even be fabricated at its point of sale.

While the prior art, such as U.S. Pat. No. 952,726 to Clinch; U.S. Pat. No. 1,692,991 to Howard; U.S. Pat. No. 2,104,248 to Stark; U.S. Pat. No. 2,335,053 to Gluck; U.S. Pat. No. 2,584,254 to Brodbeck; and U.S. Pat. No. 2,763,080 to Welch, discloses various bows and methods of making bows, none of these prior art patents shows either the unique three-piece tie bow of the present invention or the method of making the same.

Accordingly, the principal object of this invention is to provide an improved decorative bow construction and method of fabricating the same.

The above and other objects and advantages of the disclosed invention will become more readily apparent when reference is made to the following description taken in conjunction with the accompanying drawings.

DETAILED DESCRIPTION OF THE PREFERRED EMBODIMENTS

Figure 8:
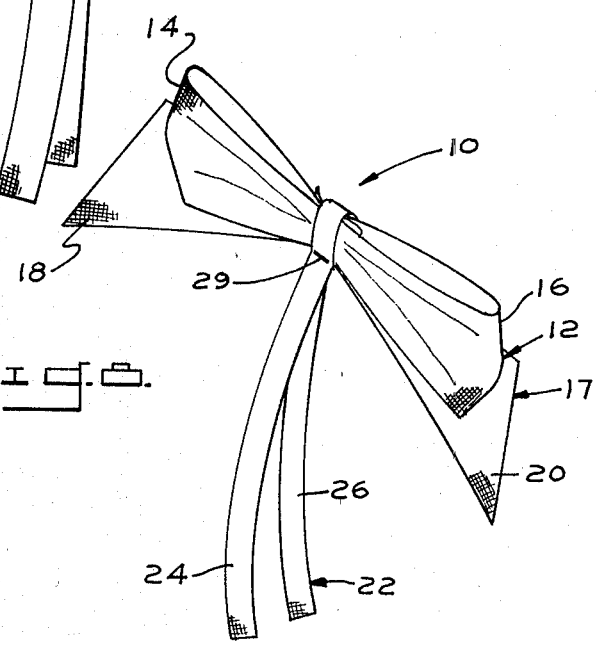
FIG. 8 is a perspective view of a tie bow constructed in accordance with the present invention.

Referring to the drawings in detail, FIG. 8 illustrates a tie bow 10 having a base portion 12 crimped at its center with two outwardly extending loops 14, 16. The bow also includes a wing portion 17 superimposed on the base portion 12 with a twist and crimp at its center. The wing portion 17 has a pair of wings 18, 20 which extend outwardly and downwardly from the center of the bow and are of substantially greater length than the loops 14, 16 of the base portion 12 of the bow. A depending tie strip 22 having two tail portions 24, 26 includes a loop disposed around the center of the bow with a fastener 29 holding the ribbon in bow form.

Figure 1:
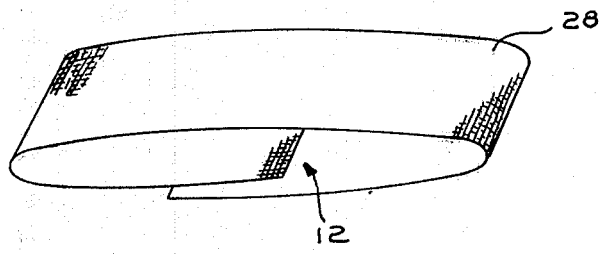
FIGS. 1–7 are views illustrating the preferred, sequential steps of forming a tie bow in accordance with the present invention.
Figure 2:
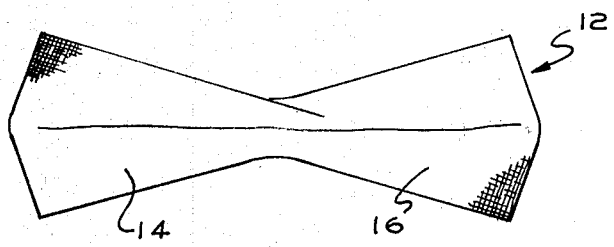
Figure 3:
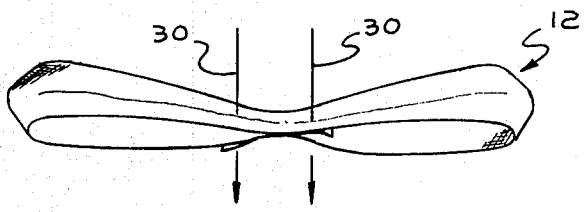

As shown in FIGS. 1–2, the base portion 12 is formed by first overlapping the ends of a single strip of one-ply ribbon 28 and flattening the convolution thus formed. Opposed side edges of the convolution are then crimped or pinched toward one another to bind the overlapping ends and form a two-ply bow (see FIG. 2 for a top plan view of the FIG. 1 convolution after it has been crimped). The finished base portion 12 is then impaled upon a pair of spaced needles 30 (see FIG. 3).

Figure 4:
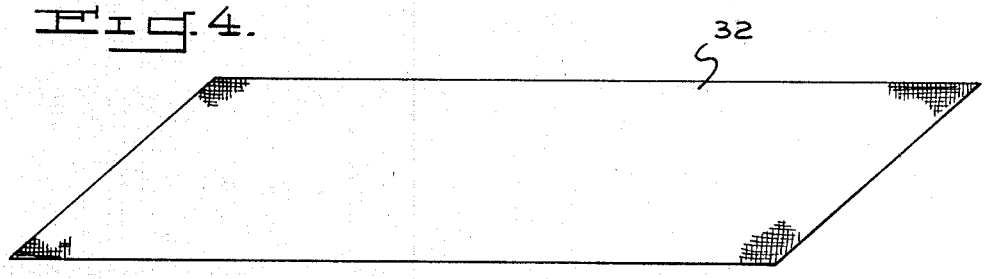
Figure 5:
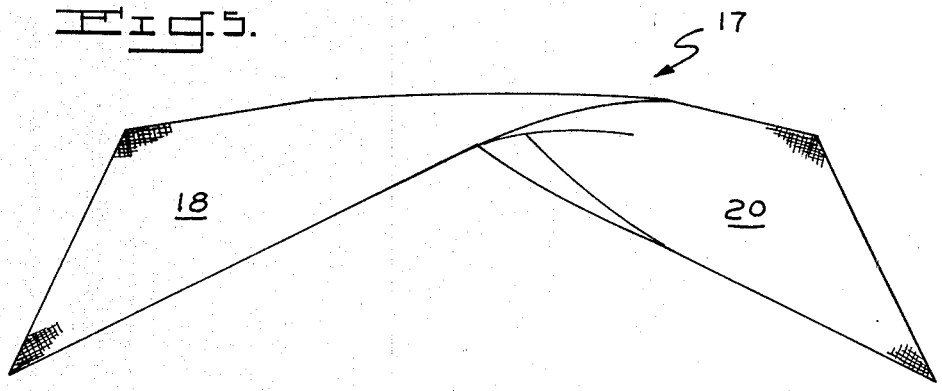
Figure 6:
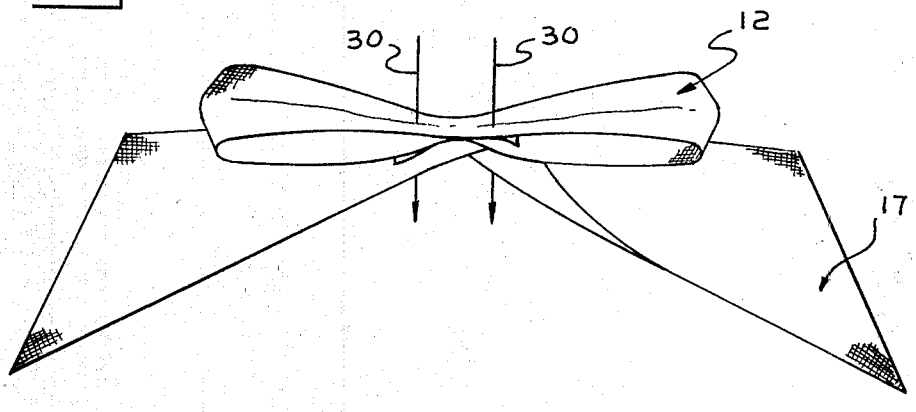

FIGS. 4–6 illustrate the method of forming the wings 18 and 20. As shown in FIG. 4, their material is a single-ply ribbon strip 32 that has been cut into a parallelogram. Strip 32 is twisted and crimped at its center so that the side of wing 18 shown in FIG. 5 is the side of strip 32 shown in FIG. 4 while the illustrated side of wing 20 is the opposite side of the strip 32. The wing members 18, 20 are then impaled on the needles 30 (see FIG. 6) in superimposed relation to the base member 12.

Figure 7:
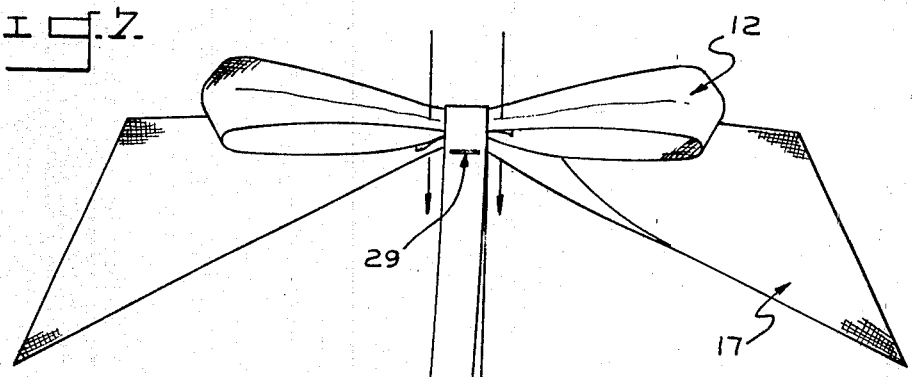

FIG. 7 shows the step of uniting the base 12 and the wings 18, 20 by the decorative tie band 22. The tie band 22 is a narrow single-ply strip of ribbon that is adapted to be inserted between the needles 30 and then looped over the crimped centers of the base and wing members, and stapled to itself at 29. This stapling forms a closed loop which securely holds the three pieces together in bow form. The finished bow 10 (FIG. 8) is then withdrawn from the needles.

The tie strip 22, used in the final steps of forming the bow 10, may be placed between the spaced needles 30 before or after the impalement of the base 12 and wing portion 17 thereon. Alternatively, though not shown, the tie strip may be made somewhat greater in width to be impaled on the needles prior to the impalement of the base and wing portion. With this second arrangement, the three pieces would all be impaled on the needles and, after being fastened together in bow form using a staple 29, the finished bow would be simply withdrawn from the retaining needles. In the first case, the width of the strip may be such that it may be wedged between the needles and held therebetween by friction until looped around the other pieces as heretofore described.

It should be understood that obvious structure modifications can be made without departing from the spirit of the invention. Accordingly, reference should be made primarily to the accompanying claims, rather than to the specification, to determine the scope of the invention.

Having thus described the invention, what is claimed is:

1. A bow-making process comprising:

(a) forming a convolution of ribbon and crimping the same at its center to provide a pair of oppositely extending loops;

(b) twisting and crimping another length of ribbon to form wing-like members;

(c) superimposing the wing members on the loops with the crimped portions adjacent one another by impaling both the loops and wing members on a pair of spaced needles to hold the crimped portions in adjacent fixed relationship;

(d) looping an elongated strip of ribbon over the crimped portions while the latter are so impaled;

(e) securing the strip to itself to hold the loops, wing members and strip together in bow form and removing the bows from said needles.

2. The bow-making process of claim 1 wherein the strip is secured to itself by stapling.

* * * * *